US006254251B1

(12) United States Patent
Washington

(10) Patent No.: US 6,254,251 B1
(45) Date of Patent: Jul. 3, 2001

(54) PORTABLE TOOL STORAGE BOX

(76) Inventor: Willie J. Washington, 604 California, Pontiac, MI (US) 48341

( * ) Notice: Subject to any disclaimer, the term of this patent is extended or adjusted under 35 U.S.C. 154(b) by 0 days.

(21) Appl. No.: 09/408,984

(22) Filed: Sep. 29, 1999

(51) Int. Cl.[7] ..... A45C 15/06

(52) U.S. Cl. ..... 362/154; 362/156; 362/155; 362/387; 362/234

(58) Field of Search ..... 362/154, 156, 362/155, 387, 234

(56) References Cited

U.S. PATENT DOCUMENTS

| | | | | |
|---|---|---|---|---|
| 3,938,132 | * | 2/1976 | Cunningham | 340/321 |
| 4,289,366 | | 9/1981 | Marks | 339/49 |
| 4,467,979 | | 8/1984 | Koehler | 242/96 |
| 4,830,579 | * | 5/1989 | Cheng | 417/234 |
| 5,143,440 | * | 9/1992 | Trampota | 362/156 |
| 5,333,408 | * | 8/1994 | Simmons | 362/154 |
| 5,459,648 | * | 10/1995 | Courtney | 362/154 |
| 5,624,029 | * | 4/1997 | Shih | 362/156 |
| 5,657,841 | | 8/1997 | Morvan | 191/12.4 |
| 5,685,421 | * | 11/1997 | Gilmore | 362/156 |
| 5,700,150 | | 12/1997 | Morin | 439/4 |
| 5,738,548 | | 4/1998 | Rutulante | 439/652 |
| 5,773,757 | | 6/1998 | Kenney et al. | 174/53 |

* cited by examiner

*Primary Examiner*—Sandra O'Shea
*Assistant Examiner*—Anabel M Ton
(74) *Attorney, Agent, or Firm*—Joseph N. Breaux

(57) ABSTRACT

A portable tool box that includes an elongated extension cord having a plug at one end to allow for positioning of the tool box near the work site and a four outlet socket assembly mounted to an exterior of the tool box to allow a workman to plug in more than one power tool while providing a close convenient location for storing, retrieving and connecting other power tools should they be required.

1 Claim, 3 Drawing Sheets

PORTABLE TOOL STORAGE BOX

TECHNICAL FIELD

The present invention relates to tool storage boxes and more particularly to a portable tool storage box that includes a box assembly including a box portion and a lid portion hingedly attached to the box portion along one side edge and detachably securable to an opposite side edge with a hasp assembly the lid portion having a light activated light source attached to an inner surface thereof and a handle attached to an exterior center thereof; the box portion having a detachable extension cord reel, a storage cavity formed therein sealable with the lid portion, a number of lidded compartments provided within the storage cavity each having a magnetically securable lid member, two exterior light assemblies each having a lens cover for emitting light from an exterior side surface of the box portion, a four plug outlet provided on an exterior side surface of the bottom portion, an electric power assembly including an elongated power cord having a plug end extending out of the box portion and a supply end in connection with the two exterior light assemblies, the four plug outlet and the light activated light source.

BACKGROUND ART

Workmen such as carpenters often require a large number of tools to properly complete a job. Many of the tools require electrical power to operate. Because construction sites and the like often only have one electrical outlet provided on a power pole, it would be desirable to have a portable tool box that included an elongated extension cord having a plug at one end to allow for positioning of the tool box near the work site and a four outlet socket assembly mounted to an exterior of the tool box to allow a workman to plug in more than one power tool while providing a close convenient location for storing, retrieving and connecting other power tools should they be required.

GENERAL SUMMARY DISCUSSION OF INVENTION

It is thus an object of the invention to provide a portable tool storage box that includes box assembly including a box portion and a lid portion hingedly attached to the box portion along one side edge and detachably securable to an opposite side edge with a hasp assembly; the lid portion having a light activated light source attached to an inner surface thereof and a handle attached to an exterior center thereof; the box portion having a detachable extension cord reel, a storage cavity formed therein sealable with the lid portion, a number of lidded compartments provided within the storage cavity each having a magnetically securable lid member, two exterior light assemblies each having a lens cover for emitting light from an exterior side surface of the box portion, a four plug outlet provided on an exterior side surface of the bottom portion, an electric power assembly including an elongated power cord having a plug end extending out of the box portion and a supply end in connection with the two exterior light assemblies, the four plug outlet and the light activated light source.

Accordingly, a portable tool storage box is provided. The portable tool storage box includes a box portion and a lid portion hingedly attached to the box portion along one side edge and detachably securable to an opposite side edge with a hasp assembly; the lid portion having a light activated light source attached to an inner surface thereof and a handle attached to an exterior center thereof; the box portion having a detachable extension cord reel, a storage cavity formed therein sealable with the lid portion, a number of lidded compartments provided within the storage cavity each having a magnetically securable lid member, two exterior light assemblies each having a lens cover for emitting light from an exterior side surface of the box portion, a four plug outlet provided on an exterior side surface of the bottom portion, an electric power assembly including an elongated power cord having a plug end extending out of the box portion and a supply end in connection with the two exterior light assemblies, the four plug outlet and the light activated light source.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
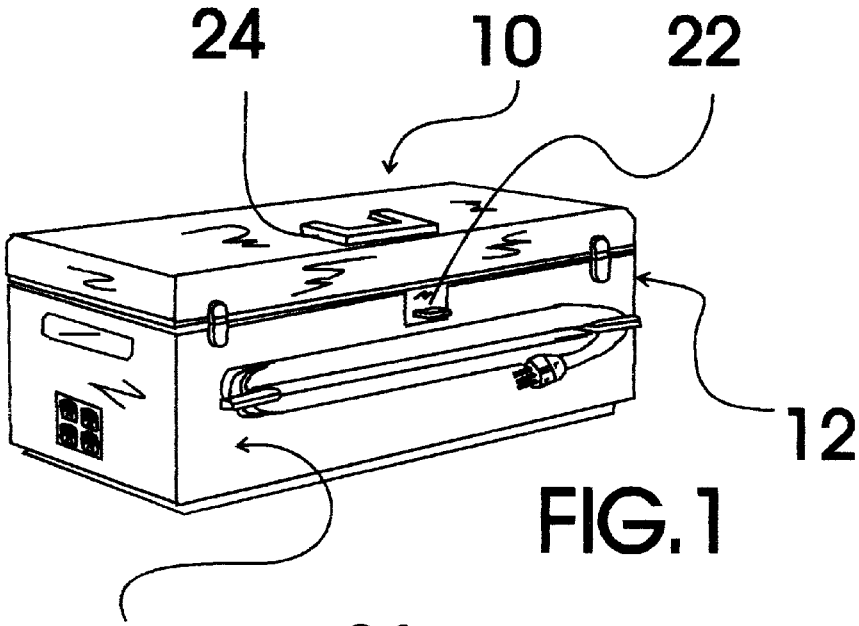
FIG. 1 is a perspective view of an exemplary embodiment of the portable tool storage box of the present invention showing the box assembly including a box portion and a lid portion hingedly attached to the box portion along one side edge and detachably securable to an opposite side edge with a hasp assembly; the lid portion having a light activated light source attached to an inner surface thereof; the box portion having a detachable extension cord reel, a storage cavity formed therein sealable with the lid portion, a number of lidded compartments provided within the storage cavity each having a magnetically securable lid member, two exterior light assemblies each having a lens cover for emitting light from an exterior side surface of the box portion, a four plug outlet provided on an exterior side surface of the bottom portion, an electric power assembly including an elongated power cord having a plug end extending out of the box portion and a supply end in connection with the two exterior light assemblies, the four plug outlet and the light activated light source.
Figure 2:
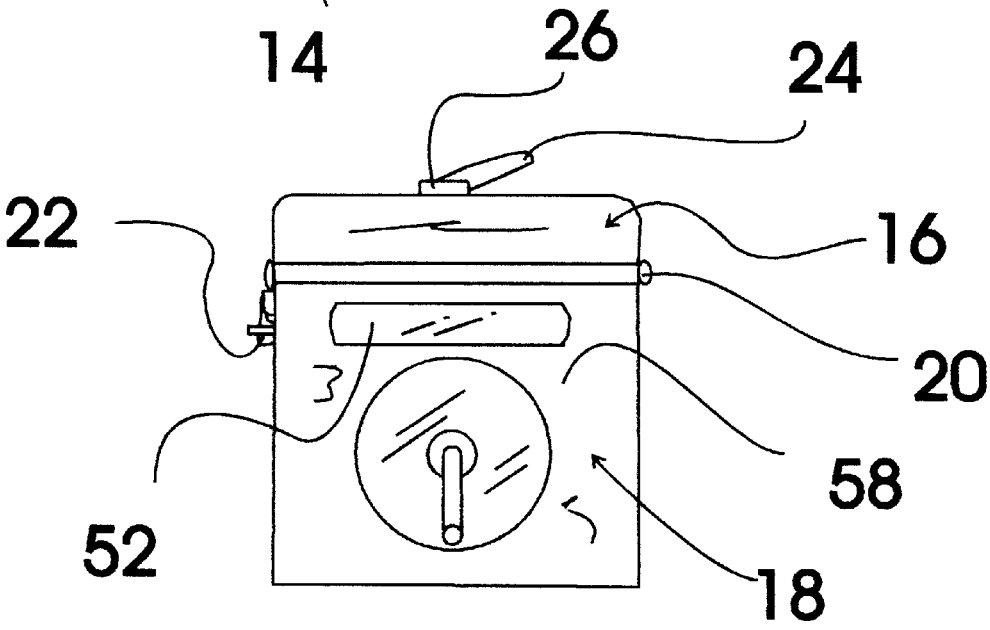
FIG. 2 is a side end view of the box assembly showing the detachable extension cord reel and the lens of one of the two exterior light assemblies.
Figure 3:
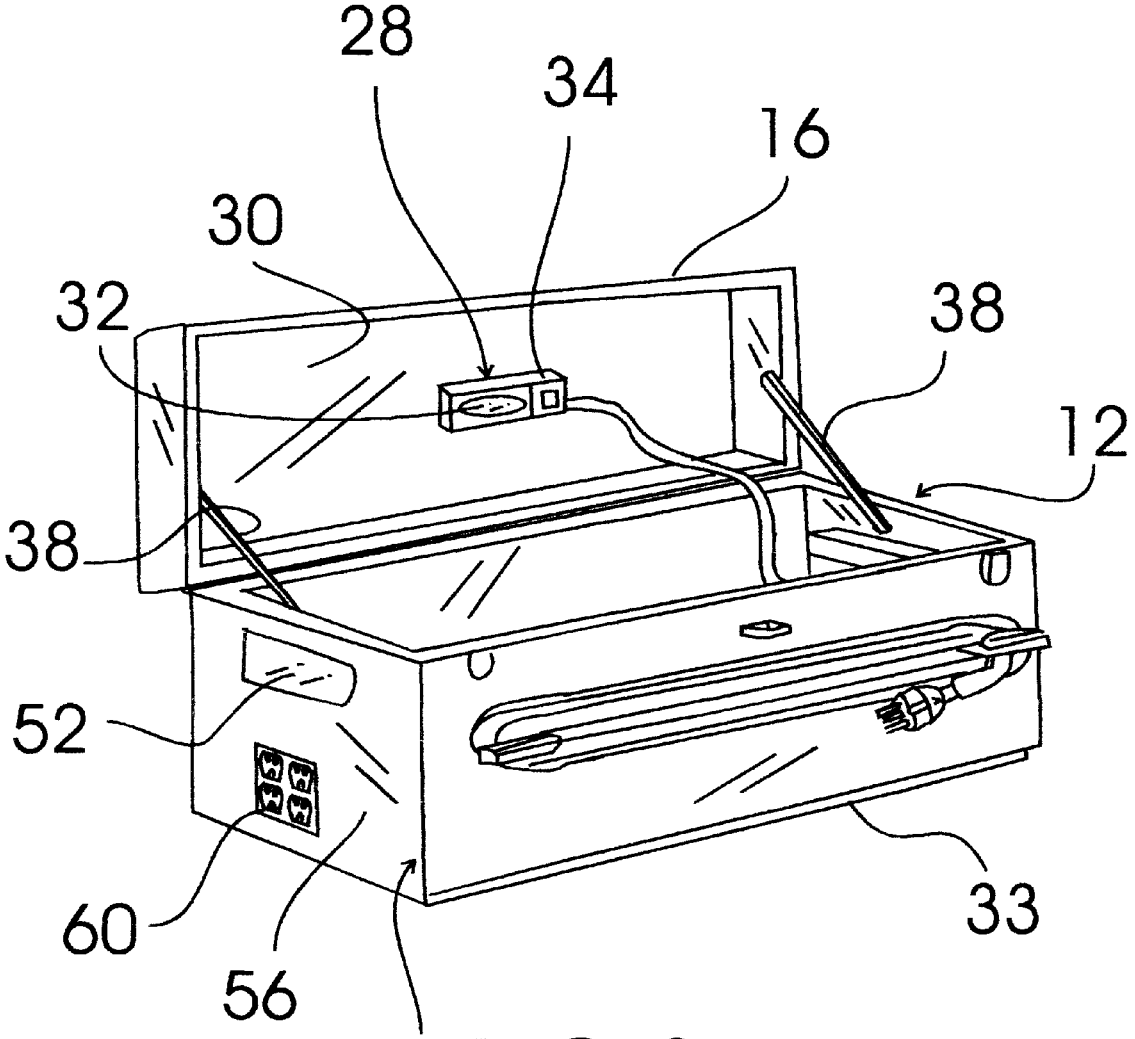
FIG. 3 is a perspective view of the box assembly with the lid portion supported in a 90 degree orientation with respect to the bottom portion by two detachable support cords.

FIG. 1 shows an exemplary embodiment of the portable tool storage box of the present invention generally designated 10. Portable tool storage box 10 includes a box assembly, generally designated 12, including a box portion, generally designated 14, and a lid portion, generally designated 16. Referring to FIG. 2, Lid portion 16 is hingedly attached to box portion 14 with a hinge 20 along one side edge and detachably securable to an opposite side edge with a hasp assembly 22 (see also FIG. 1). Lid portion 16 has a handle 24 provided on the center top exterior surface 26 thereof, referring to FIG. 3, and a light activated light source, generally designated 28, attached to an inner surface 30 thereof. Light activated light source 28 includes a light assembly 32 controlled by a light sensitive switch 34. Providing light activated light source 28 allows a user to open box assembly 12 in a dark environment and immediately be able to locate the necessary tool without fumbling around looking for an on/off switch. In this embodiment lid portion 16 is securable at a 90 degree orientation with respect to box portion 14 with two detachable cord 38. In this embodiment box portion 14 is provided with a resilient non-skid bottom surface 33 to prevent slipping of box assembly 12 and damage to floors and the like at work sites.

Figure 4:
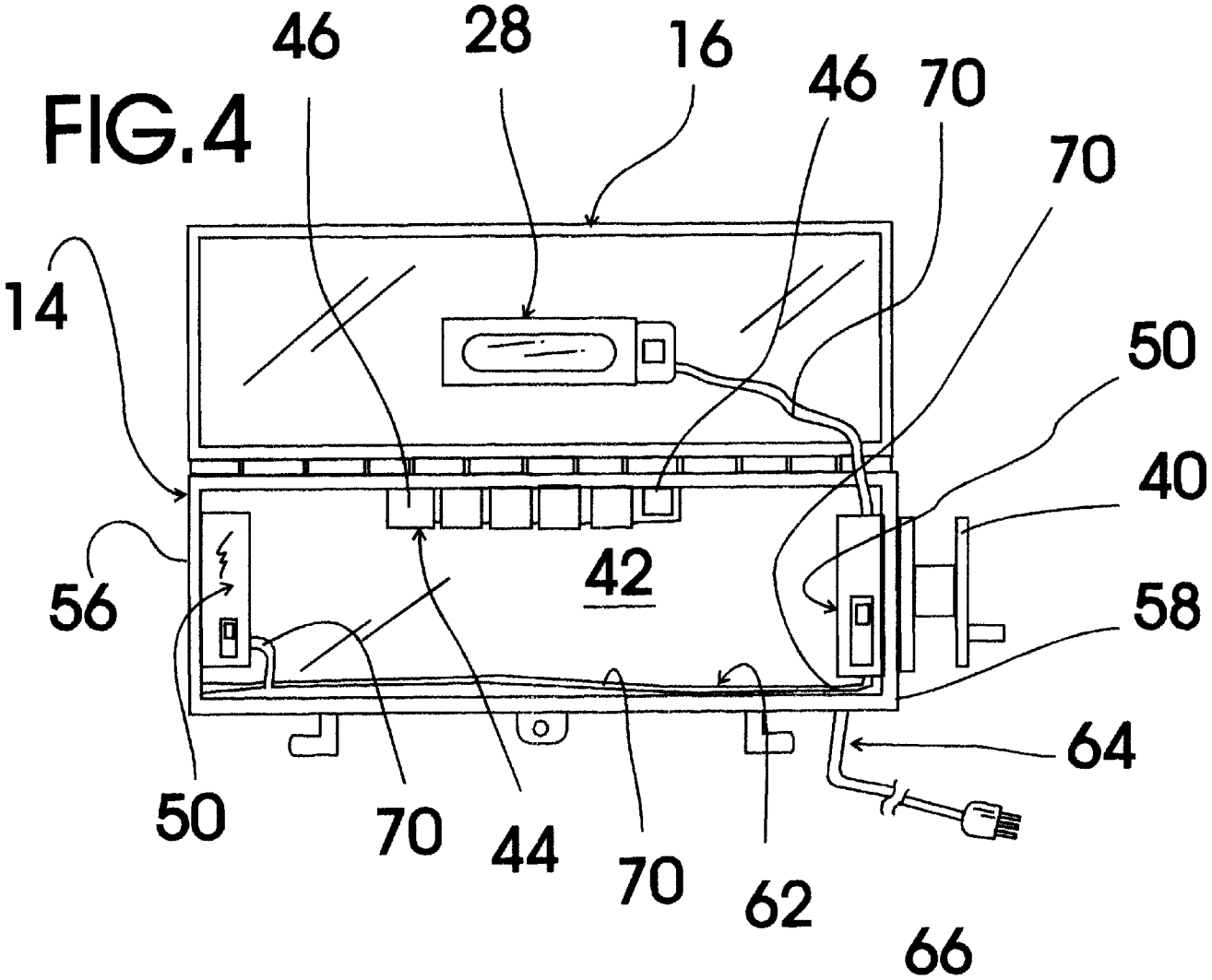
FIG. 4 is a top plan view of the box assembly with the lid portion in the open position.

With reference to FIG. 4, box portion 14 has a detachable extension cord reel 40; a storage cavity 42 formed therein sealable with lid portion 16; a number of lidded compartments 44 provided within storage cavity 42 each having a magnetically securable lid member 46; two exterior light assemblies, generally designated 50, each having a lens cover 52 (see FIGS. 2 and 3) for emitting light from an exterior side surface 56,58 respectively of box portion 14; a four plug outlet 60 (FIG. 3) provided on exterior side surface 56 of box portion 14; an electric power assembly, generally designated 62, including an elongated power cord, generally designated 64 having a plug end 66 extending out of box portion 14 and a supply end 70 in connection with the two exterior light assemblies 50, the four plug outlet 60 (FIG. 3) and the light activated light source 28.

It can be seen from the preceding description that a portable tool storage box has been provided that includes a box portion and a lid portion hingedly attached to the box portion along one side edge and detachably securable to an opposite side edge with a hasp assembly; the lid portion having a light activated light source attached to an inner surface thereof and a handle attached to an exterior center thereof; the box portion having a detachable extension cord reel, a storage cavity formed therein sealable with the lid portion, a number of lidded compartments provided within the storage cavity each having a magnetically securable lid member, two exterior light assemblies each having a lens cover for emitting light from an exterior side surface of the box portion, a four plug outlet provided on an exterior side surface of the bottom portion, an electric power assembly including an elongated power cord having a plug end extending out of the box portion and a supply end in connection with the two exterior light assemblies, the four plug outlet and the light activated light source.

It is noted that the embodiment of the portable tool storage box described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable tool storage box comprising:

a box portion; and a lid portion hingedly attached to said box portion along one side edge and detachably securable to an opposite side edge with a hasp assembly;

said lid portion having a light activated light source attached to an inner surface thereof and a handle attached to an exterior center thereof;

said box portion having a detachable extension cord reel, a storage cavity formed therein sealable with said lid portion, a number of lidded compartments provided within said storage cavity each having a magnetically securable lid member, two exterior light assemblies each having a lens cover for emitting light from an exterior side surface of said box portion, a four plug outlet provided on an exterior side surface of said bottom portion, an electric power assembly including an elongated power cord having a plug end extending out of said box portion and a supply end in connection with said two exterior light assemblies, said four plug outlet and said light activated light source.

* * * * *